US009964079B2

(12) United States Patent
Amamoto et al.

(10) Patent No.: US 9,964,079 B2
(45) Date of Patent: May 8, 2018

(54) INTAKE MANIFOLD AND ENGINE INCLUDING INTAKE MANIFOLD

(71) Applicant: TOYOTA JIDOSHA KABUSHIKI KAISHA, Toyota-shi, Aichi-ken (JP)

(72) Inventors: Yuki Amamoto, Toyota (JP); Takahiro Goto, Okazaki (JP); Norihiko Sumi, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days. days.

(21) Appl. No.: 15/391,429

(22) Filed: Dec. 27, 2016

(65) Prior Publication Data

US 2017/0204819 A1 Jul. 20, 2017

(30) Foreign Application Priority Data

Jan. 18, 2016 (JP) ..... 2016-007420

(51) Int. Cl.
*F02M 35/104* (2006.01)
*F02M 35/112* (2006.01)
*F02M 35/10* (2006.01)

(52) U.S. Cl.
CPC .... *F02M 35/10222* (2013.01); *F02M 35/104* (2013.01); *F02M 35/10026* (2013.01); *F02M 35/10091* (2013.01); *F02M 35/10281* (2013.01); *F02M 35/10295* (2013.01)

(58) Field of Classification Search
CPC ..... F02M 35/10; F02M 35/10222; F02M 35/10072; F02M 35/10091; F02M 35/10111; F02M 35/10124; F02M 35/104; F02M 35/112; F02M 35/10295; F02M 35/10281; F02M 35/10026
See application file for complete search history.

(56) References Cited

FOREIGN PATENT DOCUMENTS

| | | | |
|---|---|---|---|
| JP | 2010-151062 A | | 7/2010 |
| JP | 2013-139746 A | | 7/2013 |
| JP | 2013-177869 A | | 9/2013 |
| JP | 2013177869 A | * | 9/2013 |
| JP | 2015-001184 A | | 1/2015 |

* cited by examiner

*Primary Examiner* — Jacob Amick
(74) *Attorney, Agent, or Firm* — Oliff PLC

(57) ABSTRACT

An intake manifold includes a surge tank, and an intake passage part. An inner surface of the intake passage part includes: an inner peripheral region which is located inner side of the intake passage part in a curvature radius direction; an outer peripheral region which is located outer side of the intake passage part in a curvature radius direction; a first lateral region; and a second lateral region. The outer peripheral region includes a first inclined region, a second inclined region, and a bottom region. When seen in the section orthogonal to a center axis of the intake passage part, the first and second inclined region are curved so as to be convex outward from the intake passage part at a curvature radius. The bottom region has a shape convex outward from the intake passage part in the direction of the curvature radius.

5 Claims, 7 Drawing Sheets

COMPARATIVE EXAMPLE

COMPARATIVE EXAMPLE

COMPARATIVE EXAMPLE

INTAKE MANIFOLD AND ENGINE INCLUDING INTAKE MANIFOLD

INCORPORATION BY REFERENCE

The disclosure of Japanese Patent Application No. 2016-007420 filed on Jan. 18, 2016 including the specification, drawings and abstract is incorporated herein by reference in its entirety.

BACKGROUND OF THE INVENTION

1. Field of the Invention

The present invention relates to an intake manifold and an engine including the intake manifold.

2. Description of Related Art

Intake manifolds are known that include a surge tank and an intake passage part communicating with the surge tank and fixed to the cylinder head of the engine. For example, there are such intake manifolds into which blowby gas generated inside the crankcase of the engine is introduced. Since blowby gas contains oil and water, such fluid may accumulate inside the intake passage part of the intake manifold. If a large amount of such fluid is accumulated inside the intake passage part, depending on the operation state of the engine, a large amount of fluid may be suctioned at once by intake air into the combustion chamber of the engine, which will affect the operation state of the engine.

Therefore, in Japanese Patent Application Publication No. 2013-177869, to prevent the accumulation of a large amount of fluid inside the intake passage part, the passage sectional area of the intake passage part is gradually reduced from the upstream side toward the bottom part so as to increase the flow velocity of intake air, and thus the efficiency of suctioning the fluid into the combustion chamber of the engine is enhanced.

SUMMARY OF THE INVENTION

However, gradually reducing the passage sectional area of the intake passage part from the upstream side toward the bottom part may lead to an increase in pressure loss of the intake air in that zone of the passage. If the pressure loss of the intake air increases, the engine output may decrease as the amount of intake air introduced into the combustion chamber decreases.

Therefore, the present invention provides an intake manifold and an engine including the intake manifold, wherein, in the intake manifold, the efficiency of suctioning a fluid accumulated inside the intake passage is secured while an increase in pressure loss of intake air is prevented.

According to one aspect of the invention, an intake manifold of an engine is provided. The engine includes an engine main body. The intake manifold includes: a surge tank having an intake introduction port that is configured such that intake air is introduced through the intake introduction port, and a gas introduction port that is configured such that blowby gas is introduced from the engine main body through the gas introduction port; and an intake passage part communicating with the surge tank, the intake passage part extending so as to be curved around the surge tank, and the intake passage part being configured to be connected to a cylinder head of the engine main body. An inner surface of the intake passage part includes: an inner peripheral region being on an inner side in a curvature radius direction of the intake passage part; an outer peripheral region being apart at a distance from the inner peripheral region outward in the curvature radius direction, the outer peripheral region facing the inner peripheral region; a first lateral region and a second lateral region being located at a distance from each other in a orthogonal direction that is orthogonal to the curvature radius direction, the first lateral region and the second lateral region continuing from the inner peripheral region; a first curved-region being convex outward from the inner side of the intake passage part, the first curved-region connecting the first lateral region and the outer peripheral region; and a second curved-region being convex outward from the inner side of the intake passage part, and the second curved-region connecting the second lateral region and the outer peripheral region. The outer peripheral region includes a first inclined region, a second inclined region, and a bottom region, the first inclined region and the second inclined region extend so as to approach each other. The first inclined region and the second inclined region extend respectively from the first curved-region and the second curved-region, when seen in a section orthogonal to a center axis of the intake passage part. The first inclined region has one of two shapes that are a linear shape, and a curved shape that is convex outward from the inner side of the intake passage part at a curvature radius larger than a first curvature radius of the first curved-region, when seen in the section. The second inclined region has one of two shapes that are a linear shape, and a curved shape that is convex outward from the inner side of the intake passage part at a curvature radius larger than a second curvature radius of the second curved-region. The bottom region is located between the first inclined region and the second inclined region. When seen in the section, the bottom region has one of two shapes that are a linear shape orthogonal to the direction of the curvature radius, and a shape convex outward from the inner side of the intake passage part in the direction of the curvature radius.

In the bottom zone of the intake passage part, the outer peripheral region includes the first and second inclined regions and the bottom region, which makes it possible to secure a high level of the surface of the fluid accumulated in the bottom zone. With a high level of the fluid surface thus secured, the fluid surface is easily ruffled by the intake air passing through the intake passage part or by vibration from the engine main body. As a result, the fluid easily scatters from the fluid surface, contributing to enhancing the efficiency of suctioning the fluid accumulated inside the intake passage part. Thus, the efficiency of suctioning the fluid accumulated inside the intake passage part is secured without the passage sectional area of the intake passage part being gradually reduced from the upstream side toward the bottom part.

According to the above mentioned aspect, in a state that the intake manifold is installed on the engine main body, a bottom zone of the intake passage part may include a lowest position in a vertical direction in the section. In the state that the intake manifold is installed on the engine main body, the outer peripheral region may include the first inclined region, the second inclined region, and the bottom region in a zone including the bottom zone of the intake passage part that is located further on a lower side in the vertical direction than the surge tank.

According to the above mentioned aspect, in a state that the intake manifold is installed on the engine main body, the bottom zone of the intake passage part may include a lowest position in a vertical direction in the section. In the state that the intake manifold is installed on the engine main body, the outer peripheral region may include the first inclined region, the second inclined region, and the bottom region in a zone of the intake passage part on an upstream side from the bottom zone, including the bottom zone.

According to the above mentioned aspect, in a state that the intake manifold is installed on the engine main body, the bottom zone of the intake passage part may include a lowest position in a vertical direction in the section. The outer peripheral region in the bottom zone may be configured such that, when 10 $cm^3$ of a fluid is accumulated in the bottom zone of the intake passage part in the state of the intake manifold that is installed on the engine main body, a level of a surface of the fluid may be 3 mm or higher.

According to the above mentioned aspect, an engine is provided. The engine may include an engine main body, an intake manifold, an intake passage, and a blowby gas reduction device. The intake manifold includes a surge tank and an intake passage part. The surge tank has an intake introduction port through which intake air is configured to be introduced, and a gas introduction port through which blowby gas is configured to be introduced from the engine main body. The intake passage part communicates with the surge tank, extends so as to be curved around the surge tank, and is configured to be connected to a cylinder head of the engine main body. An inner surface of the intake passage part includes: an inner peripheral region being on an inner side in a curvature radius direction of the intake passage part; an outer peripheral region being apart at a distance from the inner peripheral region outward in the curvature radius direction, and facing the inner peripheral region; a first lateral region and a second lateral region being located at a distance from each other in a orthogonal direction that is orthogonal to the curvature radius direction, and continuing from the inner peripheral region; a first curved-region being convex outward from the inner side of the intake passage part, and connecting the first lateral region and the outer peripheral region; and a second curved-region being convex outward from the inner side of the intake passage part, and connecting the second lateral region and the outer peripheral region. In a state that the intake manifold is installed on the engine main body, a bottom zone of the intake passage part includes a lowest position in a vertical direction in a section orthogonal to a center axis of the intake passage part. The outer peripheral region includes a first inclined region, a second inclined region, and a bottom region. The first inclined region and the second inclined region extend so as to approach each other and extend respectively from the first curved-region and the second curved-region. When seen in the section, the first inclined region has one of two shapes that are a linear shape, and a curved shape that is convex outward from the inner side of the intake passage part at a curvature radius larger than a first curvature radius of the first curved-region. When seen in the section, the second inclined region has one of two shapes that are a linear shape, and a curved shape that is convex outward from the inner side of the intake passage part at a curvature radius larger than a second curvature radius of the second curved-region. The bottom region is located between the first inclined region and the second inclined region. When seen in the section, the bottom region has one of two shapes that are a linear shape orthogonal to the direction of the curvature radius, and a shape convex outward from the inner side of the intake passage part in the direction of the curvature radius. The intake passage is connected to the intake introduction port. The blowby gas reduction device is provided between the gas introduction port and a crankcase of the engine main body.

According to the present invention, it is possible to provide an intake manifold in which the efficiency of suctioning a fluid accumulated inside the intake passage part is secured while an increase in pressure loss of intake air is prevented, and an engine including this intake manifold.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

In the following, a preferred embodiment of the present invention will be described with reference to the drawings.

Figure 1:
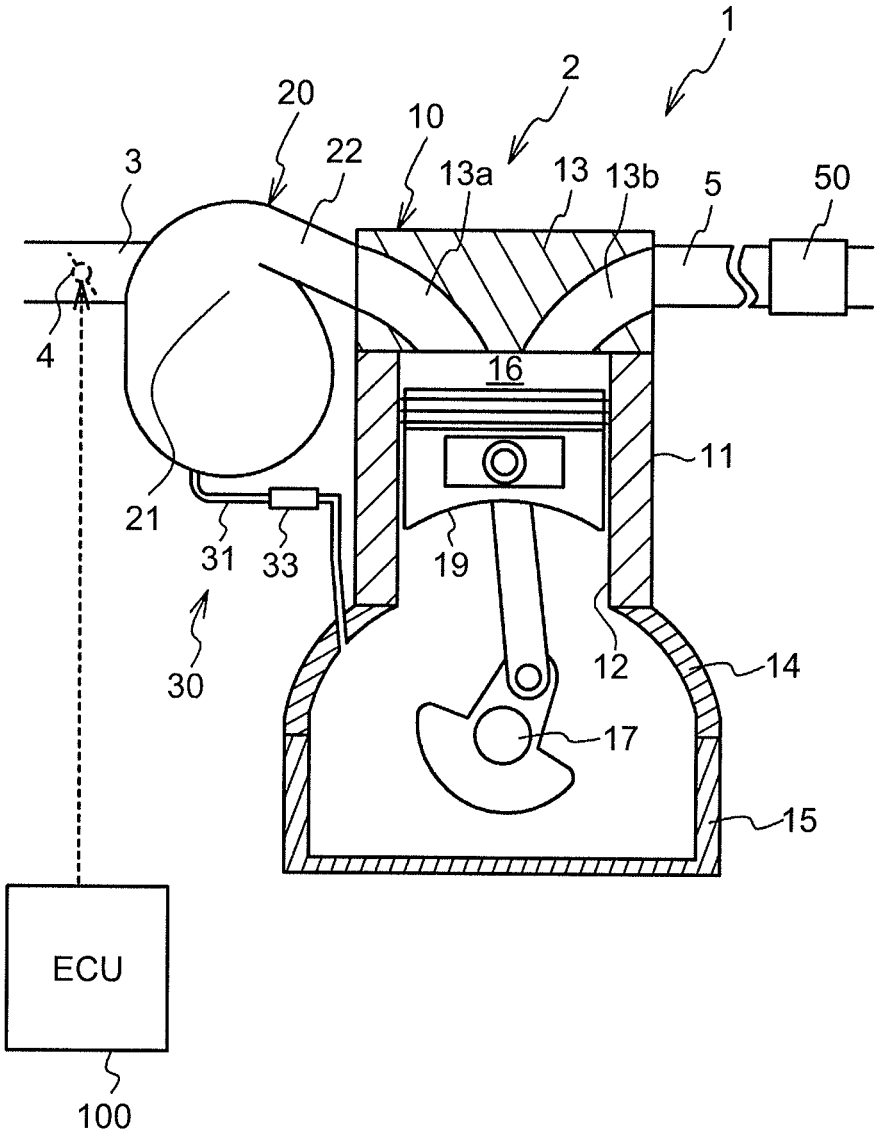
FIG. 1 is a schematic configurational view of an engine control device of an embodiment.

FIG. 1 is a schematic configurational view of an engine control device 1 of the embodiment. The engine control device 1 includes an engine 2 and an electronic control unit (ECU) 100 that controls the driving of the engine 2. The engine 2 includes an intake passage 3, an exhaust passage 5, an engine main body 10, an intake manifold (hereinafter referred to as a manifold) 20, a blowby gas reduction device 30, an exhaust purification catalyst 50, and an exhaust manifold (not shown).

The engine main body 10 of the embodiment is a gasoline-fueled four-cylinder engine, but the present invention is not limited to this example. The engine main body 10 includes a cylinder block 11, a cylinder head 13 and a crankcase 14 mounted respectively on the upper and lower sides of the cylinder block 11, and an oil pan 15 mounted on the lower side of the crankcase 14. In the engine main body 10, air is suctioned from the intake passage 3 through the manifold 20 and an intake port 13*a* of the cylinder head 13 into a combustion chamber 16.

Inside the combustion chamber 16, fuel is injected from a fuel injection valve, and a mixture of the fuel and the intake air is ignited by a spark plug, so that the mixture is combusted. Accordingly, a piston 19 reciprocates inside the cylinder 12 and a crankshaft 17 rotates. Then, exhaust gas resulting from the combustion of the mixture is discharged from the combustion chamber 16 through an exhaust port 13b of the cylinder head 13 and the exhaust manifold into the exhaust passage 5. The exhaust gas discharged into the exhaust passage 5 is purified by the exhaust purification catalyst 50 provided in the exhaust passage 5 before being discharged to the outside of the exhaust passage 5.

The ECU 100 includes a central processing unit (CPU), a read-only memory (ROM), and a random-access memory (RAM). The ECU 100 controls the operation state of the engine 2 according to a control program stored in advance in the ROM and on the basis of information from sensors, information stored in advance in the ROM, etc. For example, the ECU 100 regulates the amount of air suctioned into the engine main body 10 by controlling the lift of a throttle valve 4 provided in the intake passage 3. The intake air is introduced from the intake passage 3 through the manifold 20 into the combustion chamber 16 of the engine main body 10.

While details will be given later, the manifold 20 is integrally provided with a surge tank 21 into which the intake air from the intake passage 3 is introduced, and a plurality of intake passage parts (hereinafter referred to simply as passage parts) 22 communicating with the surge tank 21 and connected to the cylinder head 13 of the engine main body 10. The passage parts 22 are provided for the respective cylinders of the engine main body 10.

The blowby gas reduction device 30 is provided between the manifold 20 and the crankcase 14, and includes a blowby gas pipe 31 and a valve 33 provided on the route of the blowby gas pipe 31. One end of the blowby gas pipe 31 is connected to the crankcase 14, while the other end of the blowby gas pipe 31 is connected to the surge tank 21 of the manifold 20. Through the blowby gas pipe 31, blowby gas that is a mixture of uncombusted gas and exhaust gas having entered from the combustion chamber 16 into the crankcase 14 returns into the surge tank 21. The valve 33 regulates the flow rate of the blowby gas.

Inside the crankcase 14, as the crankshaft 17 rotates at high speed, lubricating oil stored in the oil pan 15 is scattered in the form of mist. Therefore, the blowby gas contains such oil. The blowby gas also contains water present in the exhaust gas. Accordingly, as the blowby gas is introduced into the manifold 20, fluid, such as water and oil, may accumulate inside the manifold 20. In the embodiment, the efficiency of suctioning the fluid accumulating inside the manifold 20 is enhanced. The manifold 20 will be described below.

Figure 2:
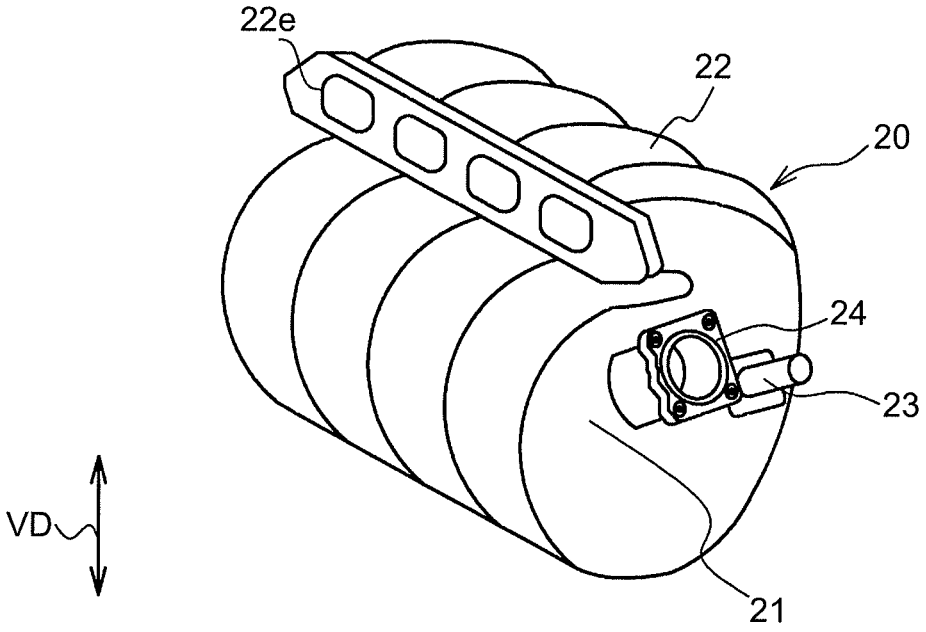
FIG. 2 is an external perspective view of a manifold.

FIG. 2 is an external perspective view of the manifold 20. A gas introduction part 23 and an intake introduction part 24 are provided in a side wall of the manifold 20. The blowby gas pipe 31 is connected to the gas introduction part 23, and the blowby gas is introduced into the manifold 20. The intake passage 3 is connected to the intake introduction part 24, and air from the intake passage 3 is introduced into the manifold 20. In FIG. 2, a vertical direction VD in the state of the manifold 20 being installed on the engine main body 10 is indicated.

Figure 3:
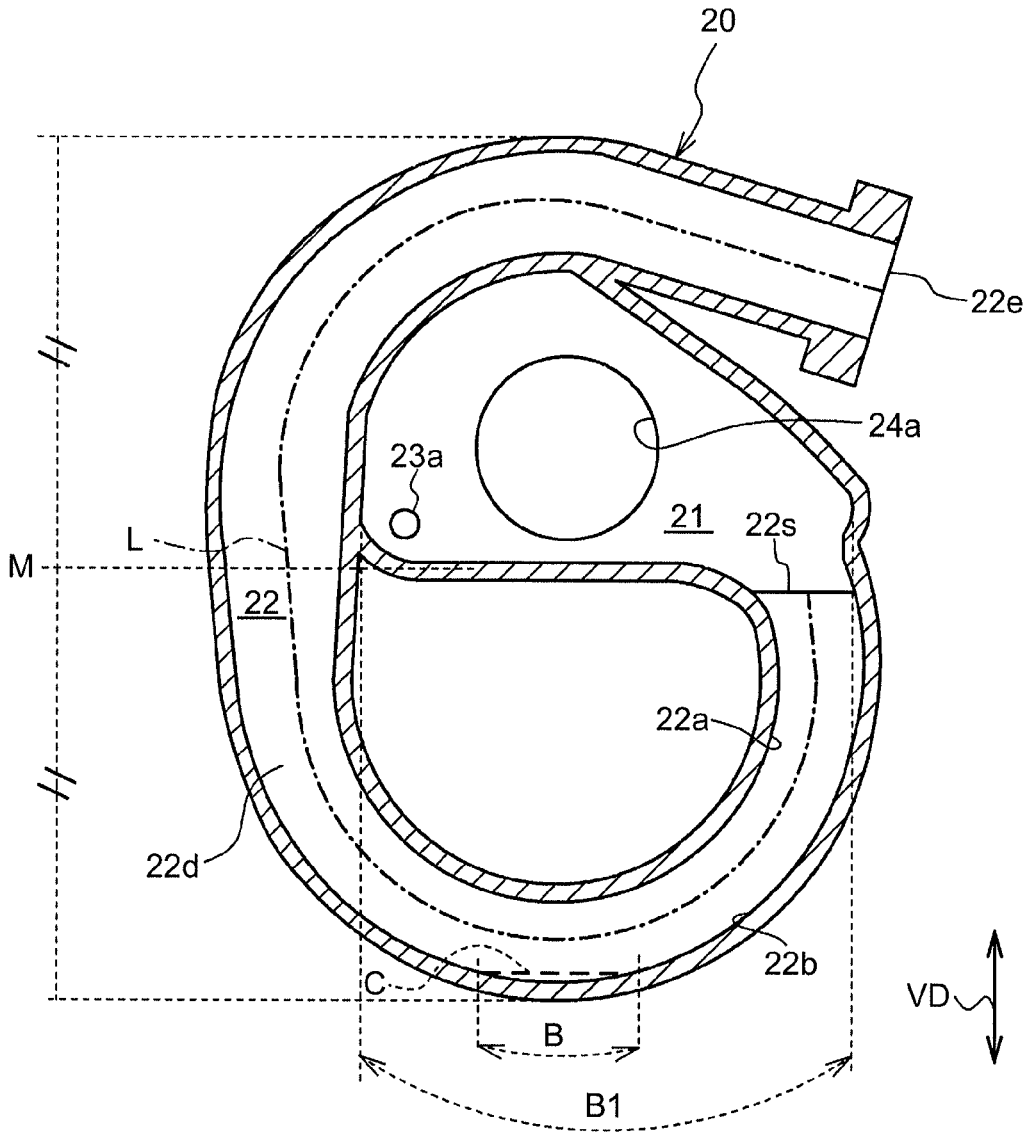
FIG. 3 is a longitudinal sectional view of the manifold.

FIG. 3 is a longitudinal sectional view of the manifold 20. FIG. 3 is a longitudinal sectional view of the manifold 20 in the state of being installed on the engine main body 10, and shows a section including the centerline of one passage part 22. As shown in FIG. 3, a gas introduction port 23*a* communicating with the blowby gas pipe 31 and an intake introduction port 24*a* communicating with the intake introduction part 24 are formed in a side wall of the surge tank 21.

The passage part 22 extends so as to be curved in a substantially arc shape that surrounds the surge tank 21 from the upper and lower sides in the vertical direction VD. An inlet 22*s* of the passage part 22 is located inside the surge tank 21 and always communicates with the surge tank 21. An outlet 22*e* of the passage part 22 is connected to an intake port of the cylinder head 13 of the engine main body 10. The passage part 22 is formed so as to gradually increase in passage sectional area from the inlet 22*s* toward the outlet 22*e*, but instead may be formed so as to be substantially constant in passage sectional area. An inner surface of the passage part 22 includes an inner peripheral region 22*a* located on the inner side of the curved passage part 22 in the direction of the curvature radius thereof, an outer peripheral region 22*b* that faces the inner peripheral region 22*a* and is located further on the outer side in the direction of the curvature radius than the inner peripheral region 22*a*, and lateral regions 22*c*, 22*d* to be described in detail later. In this specification, the radial direction means the direction of the curvature radius of the curved passage part 22.

In FIG. 3, a bottom zone B of the passage part 22 in the vertical direction VD in the state of the manifold 20 being installed on the engine main body 10, a middle position M in the height of the manifold 20, and a predetermined zone B1 are indicated. The middle position M and the predetermined zone B1 will be described later. The bottom zone B includes a portion of the intake passage part 22 that is located on the bottom side in the vertical direction in the state of the intake manifold 20 being installed on the engine main body 10. The bottom zone B is a part where the fluid contained in the blowby gas flowing through the manifold 20 is likely to accumulate. In this embodiment, the inner surface of the passage part 22 in the bottom zone B is shaped so as to maintain a high level of the surface of the fluid accumulated therein. This will be described in detail below.

Figure 4A:
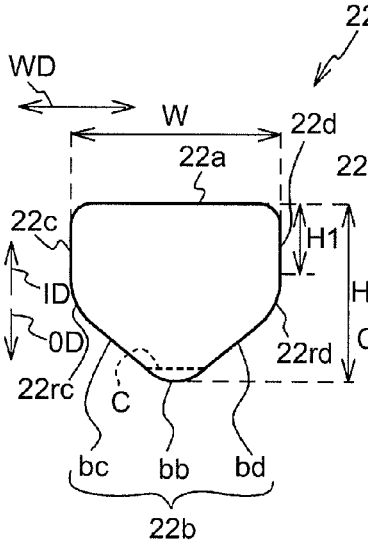
FIG. 4A is a view showing a passage section perpendicular to the centerline of a passage part in a bottom zone of the embodiment.

FIG. 4A shows a passage section perpendicular to a center axis L of the passage part 22 in the bottom zone B of the embodiment. In FIG. 4A, for easy understanding, a radially inward direction (hereinafter referred to simply as an inward direction) ID, a radially outward direction (hereinafter referred to simply as an outward direction) OD, and a width direction WD orthogonal to the radial direction are indicated. In the bottom zone B, the inward direction ID and the outward direction OD correspond respectively to the upward direction and the downward direction in the vertical direction VD.

As shown in FIG. 4A, the passage section of the passage part 22 has a substantially D-shape. The inner peripheral region 22*a* is located on the side of the surge tank 21 and perpendicular to the radial direction. The lateral region 22*c* is one example of the first lateral region. The lateral region 22*c* extends from the left-side end of the inner peripheral region 22*a* in the outward direction OD and is continuously connected to the outer peripheral region 22*b*. The lateral region 22*d* faces the lateral region 22c. The lateral region 22*d* extends from the right-side end of the inner peripheral region 22*a* in the outward direction OD and is continuously connected to the outer peripheral region 22*b*. The lateral region 22*d* is one example of the second lateral region. The lateral regions 22*c*, 22*d* are parallel to each other and face each other across a distance in the width direction WD. In FIG. 4A, a width W of the passage section of the passage part 22 orthogonal to the radial direction is indicated, and the width W is equivalent to the distance between the lateral regions 22*c*, 22*d*.

An curved-region 22*rc* is located between the lateral region 22*c* and the outer peripheral region 22*b*. The curved-region 22*rc* is continuously connected to the lateral region 22*c* and the outer peripheral region 22*b*. The curved-region

22*rc* is curved so as to be convex outward from the passage part 22. Similarly, an curved-region 22*rd* is located between the lateral region 22*d* and the outer peripheral region 22*b*. The curved-region 22*rd* is continuously connected to the lateral region 22*d* and the outer peripheral region 22*b*. The curved-region 22*rd* is curved so as to be convex outward from the passage part 22. A first curvature radius of the curved-region 22*rc* and a second curvature radius of the curved-region 22*rd* are substantially the same. The curved-region 22*rc* and the curved-region 22*rd* are examples of the first curved-region and the second curved-region.

The outer peripheral region 22*b* is located further away from the surge tank 21 than the inner peripheral region 22*a* and faces the inner peripheral region 22*a*. As shown in FIG. 4A, the outer peripheral region 22*b* has a shape convex in the outward direction OD. In other words, the width of the passage section surrounded by the outer peripheral region 22*b* narrows gradually in the outward direction OD. Thus, the shape of the outer peripheral region 22*b* can also be described as a substantially V-shape. Or, the shape defined by the lateral regions 22*c*, 22*d*, the curved-regions 22*rc*, 22*rd*, and the outer peripheral region 22*b* can be described as a substantially U-shape.

Specifically, the outer peripheral region 22*b* includes inclined regions bc, bd smoothly continuing to the lateral regions 22*c*, 22*d*, respectively, and a bottom region bb smoothly continuing between the inclined regions bc, bd. The inclined regions bc, bd approach each other as these regions extend radially outward from the curved-regions 22*rc*, 22*rd*, respectively, and are curved so as to be convex outward from the passage part 22. The inclined region bc and the inclined region bd are examples of the first inclined region and the second inclined region.

The bottom region bb is located between the inclined regions bc, bd and continues to each of the inclined regions bc, bd. The bottom region bb is located at the center of the width W, curved so as to be convex in the outward direction OD, and not parallel to the width direction WD. In FIG. 4A, a height H of the passage section of the passage part 22 in the radial direction is indicated, and the height H is equivalent to the distance between the bottom region bb and the inner peripheral region 22*a*. A length H1 indicates the length of the lateral regions 22*c*, 22*d* in the radial direction. The length H1 is, for example, about half the height H, but the present invention is not limited to this example. For example, the length H1 is at least 2 mm. For example, the length H1 is equal to or less than two thirds of the height H.

In the embodiment, as shown in FIG. 4A, the outer peripheral region 22*b* has a shape convex in the outward direction OD in the predetermined zone B1 of the passage part 22 including the bottom zone B. The inner surface of the passage part 22 in the other zone of the passage part 22 than the predetermined zone B1 has a substantially rectangular shape. Here, the predetermined zone B1 refers to the zone of the passage part 22 located further on the lower side in the vertical direction VD than the surge tank 21. In the predetermined zone B1 other than the bottom zone B, the angle between the inclined regions bc, bd or the height H indicated in FIG. 4A may be different as long as the outer peripheral region 22*b* has a shape convex in the outward direction OD. That is, in the predetermined zone B1 other than the bottom zone B, the angle between the inclined regions bc, bd may be larger than that in the bottom zone B, and the height H may be smaller than that in the bottom zone B. This is to provide smooth continuity between the shape of the inner surface in the predetermined zone B1 and the shape of the inner surface in the other zone than the predetermined zone B1. Thus, an increase in pressure loss of the intake air can be prevented.

Figure 4B:
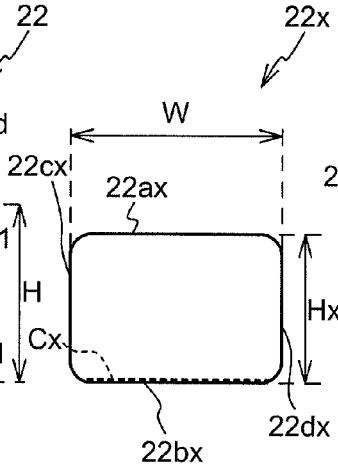
FIG. 4B is a view showing a passage section in a bottom zone of a passage part that is a first comparative example.
Figure 4C:
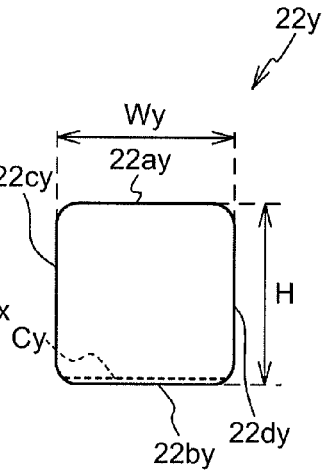
FIG. 4C is a view showing a passage section in a bottom zone of a passage part that is a second comparative example.

The effects of the shape of the passage section in the bottom zone B of the passage part 22 of the embodiment will be described through a comparison with comparative examples. FIGS. 4B and 4C are views showing passage sections in the bottom zones of passage parts 22*x*, 22*y* that are first and second comparative examples, respectively. For the comparative examples, reference signs similar to those of the embodiment will be used to omit overlapping description. The sectional areas of the passage sections shown in FIGS. 4A to 4C are the same.

The passage sections of the passage parts 22*x*, 22*y* both have a substantially rectangular shape. The passage part 22*x* of the first comparative example includes an inner peripheral region 22*ax* and an outer peripheral region 22*bx* that are parallel to the width direction WD and face each other, and lateral regions 22*cx*, 22*dx* that are parallel to the radial direction and face each other. Similarly, the passage part 22*y* of the second comparative example includes an inner peripheral region 22*ay* and an outer peripheral region 22*by* that are parallel to the width direction WD and face each other, and lateral regions 22*cy*, 22*dy* that are parallel to the radial direction and face each other.

The width that is the distance between the lateral regions 22*cx*, 22*dx* is the same as the width W of the passage part 22 of the embodiment. A height Hx is the distance between the outer peripheral region 22*bx* and the inner peripheral region 22ax, and is smaller than the height H of the passage part 22 of the embodiment. A width Wy is the distance between the lateral regions 22*cy*, 22*dy*, and is narrower than the width W of the passage part 22 of the embodiment. The height that is the distance between the outer peripheral region 22*by* and the inner peripheral region 22*ay* is the same as the height H of the passage part 22 of the embodiment.

FIGS. 4A to 4C show fluid surfaces C, Cx, Cy in a state where, with the engine 2 stopped, 10 $cm^3$ of a fluid is accumulated in each of the bottom zones inside the passage parts 22, 22*x*, 22*y*. The level of the fluid surface C is equivalent to the distance from the bottom region bb of the outer peripheral region 22*b* to the fluid surface C in the inward direction ID. The level of the fluid surface Cx is equivalent to the distance from the outer peripheral region 22*bx* to the fluid surface Cx in the inward direction ID. Similarly, the level of the fluid surface Cy is equivalent to the distance from the outer peripheral region 22*by* to the fluid surface Cy in the inward direction ID.

Of these levels of fluid surface, the level of the fluid surface C of the embodiment is the highest and the level of the fluid surface Cx of the first comparative example is the lowest. The reason why the level of the fluid surface Cx is the lowest is because the width W of the first comparative example is the same as the width of the embodiment but is larger than the width Wy of the second comparative example, and the width of the first comparative example is larger on the side of the outer peripheral region 22*bx*. The reason why the level of the fluid surface C is the highest is because, compared with the first and second comparative examples in which the width is larger on the side of the outer peripheral region 22*bx* and the outer peripheral region 22*by*, the outer peripheral region 22*b* of the embodiment has a shape with the width narrowed in the outward direction OD, which makes it difficult for the fluid to spread in the width direction WD.

Figure 5:
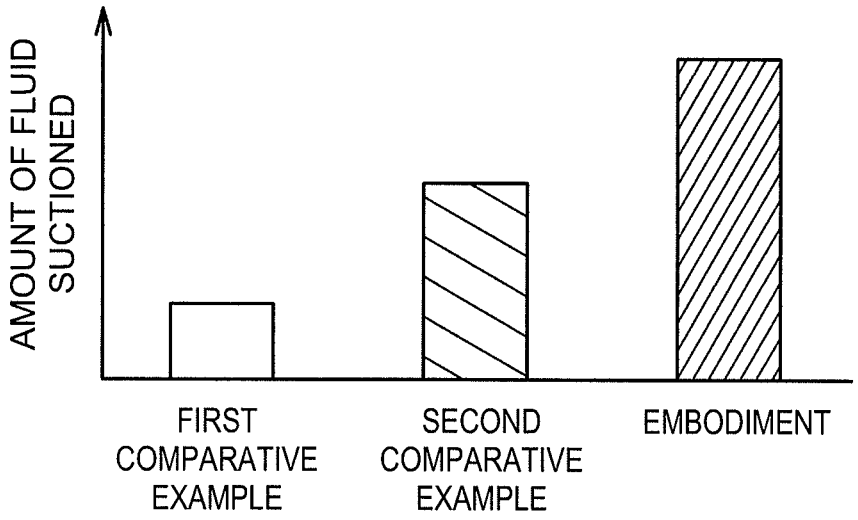
FIG. 5 is a graph showing the amount of fluid suctioned into an engine main body.

The amount of fluid suctioned into the engine main body 10 by intake air was checked by driving the engine 2 under the same conditions and for the same period with a fluid accumulated in each of the bottom zones of the passage parts 22, 22*x*, 22*y*. Specifically, the amount of fluid remaining in each of the bottom zones of the passage parts 22, 22*x*, 22*y* after the engine 2 had been stopped was measured, and a value obtained by subtracting the amount of remaining fluid from the amount of fluid before driving of the engine 2 was calculated as the amount of fluid suctioned into the engine main body 10. FIG. 5 is a graph showing the amount of fluid suctioned into the engine main body 10. The amount of fluid suctioned is the largest in the embodiment and the smallest in the first comparative example.

Figure 6A:
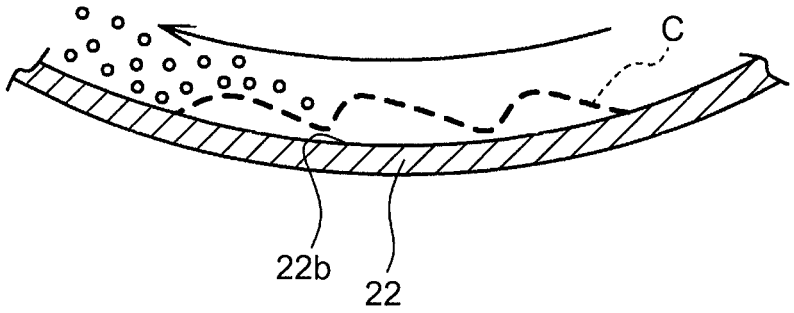
FIG. 6A is a view illustrating the state of a fluid surface during driving of an engine in the embodiment.
Figure 6B:
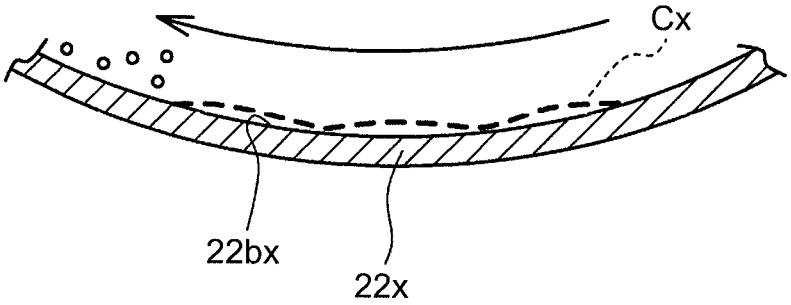
FIG. 6B is a view illustrating the state of a fluid surface during driving of the engine in the first comparative example.

Reasons for these results will be described. FIG. 6A and FIG. 6B are views illustrating the state of the fluid surfaces C, Cx during driving of the engine 2 in the embodiment and the first comparative example. Since the fluid surface C is at a higher level than the fluid surfaces Cx, Cy, it is likely that the fluid surface C is more easily ruffled than the fluid surface Cx by vibration from the engine main body 10 or the passage of intake air as shown in FIGS. 6A and 6B. Accordingly, the fluid easily scatters from the fluid surface C. By contrast, since the fluid surface Cx is at a lower level than the fluid surfaces C, Cy, it is likely that the fluid surface Cx is not easily ruffled and accordingly the fluid does not easily scatter from the fluid surface Cx.

Thus, the inclined regions bc, bd of the outer peripheral region 22*b* in the bottom zone B of the passage part 22 of the embodiment are linear and inclined so as to approach each other, so that the distance in the width direction W between the inclined regions bc, bd decreases in the outward direction OD, which allows a high level of the fluid surface C to be secured. Accordingly, the efficiency of suctioning the fluid inside the passage part 22 is enhanced. Moreover, with the outer peripheral region 22*b* thus shaped, for example, droplets adhering to the lateral region 22*c*, the lateral region 22*d*, the curved-region 22*rc*, the curved-region 22*rd*, the inclined region bc, or the inclined region bd are easily gathered to one part of the bottom region bb due to the action of gravity or vibration from the engine main body 10. Thus, the fluid generated inside the passage part 22 can be quickly gathered in the bottom region bb, and the fluid can be quickly suctioned into the engine main body 10 before a large amount of fluid is accumulated inside the passage part 22.

Since the manifold 20 of the embodiment has enhanced fluid suctioning efficiency, for example, it is not necessary to separately provide a drain passage which has one end connected to the bottom zone B and the other end connected to the intake passage 3 and through which the fluid accumulated in the bottom zone B is suctioned into the intake passage 3 by the negative pressure inside the intake passage 3. Thus, compared with when such a passage is provided, an increase in manufacturing cost is prevented in the embodiment.

It is desirable that the shape of the outer peripheral region 22*b* in the bottom zone B is such that, if 10 $cm^3$ of a fluid is accumulated in the bottom zone B of the passage part 22, the level of the fluid surface C is 3 mm or higher. Securing a high level of the fluid surface with such a small amount of fluid makes it possible to facilitate the scatter of the fluid from the fluid surface before a large amount of fluid accumulates in the bottom zone B, and thus to prevent the accumulation of a large amount of fluid in the bottom zone B. Accordingly, when the amount of air suctioned increases due to a request for rapid acceleration from a state where a large amount of fluid has accumulated while the state of idle operation continues, for example, the fluid is prevented from being suctioned at once in a large amount into the engine main body 10.

Figure 7A:
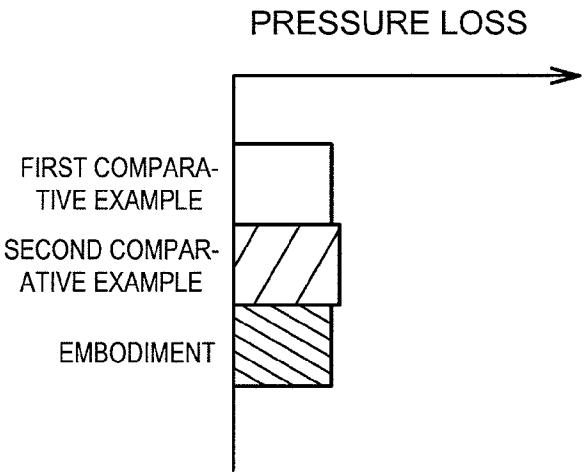
FIG. 7A is a graph showing the pressure loss of intake air at a center position in the passage section of the passage part in each of the embodiment and the first and second comparative examples.
Figure 7B:
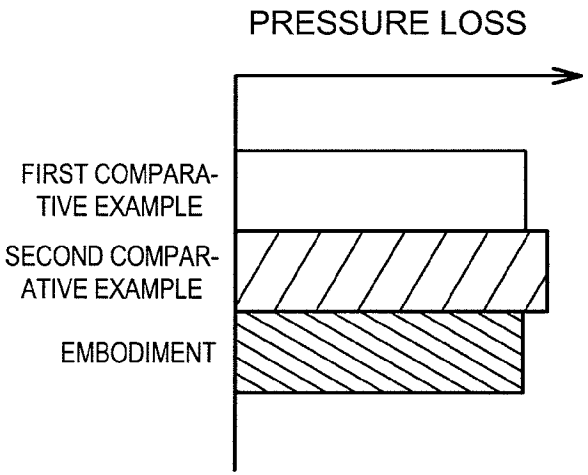
FIG. 7B is a graph showing the pressure loss in the vicinity of an inner surface in the passage section in each of the embodiment and the first and second comparative examples.

Next, the pressure loss of intake air in the embodiment and the first and second comparative examples will be described. The pressure loss of intake air was calculated by a computer-aided engineering (CAE) analysis on the assumption of a case where there is no fluid in the bottom zones of the passage parts 22 to 22*y* and the engine 2 is driven in a steady state. FIG. 7A is a graph showing the pressure loss of intake air at a center position in the passage section of each of the embodiment and the first and second comparative examples. FIG. 7B is a graph showing the pressure loss in the vicinity of the inner surface of the passage section in each of the embodiment and the first and second comparative examples.

As shown in FIG. 7A and FIG. 7B, no significant difference in pressure loss was found. A possible reason for this result is that an increase in pressure loss of intake air is prevented in the embodiment, since the lateral regions 22*c*, 22*d* are continuously connected to the outer peripheral region 22*b* through the smoothly curved curved-regions 22*rc*, 22*rd* and the bottom region bb is curved so as to be convex radially outward. Thus, in the manifold 20 of the embodiment, an increase in pressure loss of intake air is prevented.

As described above, the passage sectional area of the passage part 22 is substantially constant, or gradually increases from the upstream side toward the downstream side. Accordingly, compared with an intake passage part having a zone in which the passage sectional area decreases gradually, the pressure loss of intake air is reduced in the passage part 22 of the embodiment. Thus, in the manifold 20 of the embodiment, the efficiency of suctioning the fluid inside the passage part 22 is enhanced while an increase in pressure loss of intake air is prevented.

It is desirable that the angle between the inclined regions bc, bd in the bottom zone B is, for example, 90 degrees or larger and smaller than 150 degrees. If the angle is smaller than 90 degrees, the pressure loss of intake air may increase, while if the angle is 150 degrees or larger, it is difficult to secure a high level of the fluid surface. The angle between the inclined regions bc, bd in the predetermined zone B1 other than the bottom zone B may be smaller than 180 degrees.

In the above embodiment, the example in which the outer peripheral region 22*b* in the predetermined zone B1 has a shape convex in the outward direction OD has been described, but the zone in which the outer peripheral region 22*b* has such a shape is not limited to the predetermined zone B1. For example, as shown in FIG. 3, the shape of the outer peripheral region 22*b* may be convex in the outward direction OD in the zone of the passage part 22 from the bottom zone B to the middle position M in the state of the manifold 20 being installed on the engine main body 10. This is because an increase in pressure loss of intake air can be thus prevented. In the case where the shape of the outer peripheral region 22*b* is convex in the outward direction OD in the zone from the bottom zone B to the inlet 22*s* on the upstream side as well, the outer peripheral region 22*b* may be flat in the zone on the downstream side from the bottom zone B as in the first and second comparative examples. The zone in which the outer peripheral region 22*b* is convex in the outward direction OD may stretch over the entire passage part 22.

In the above embodiment, the first curvature radius of the curved-region 22*rc* and the second curvature radius of the curved-region 22*rd* are the same, but these radii of curvature may be different from each other. In that case, too, the width between the inclined regions bc, bd narrows gradually in the outward direction OD, so that a high level of the fluid surface C can be secured.

In the above embodiment, the inclined regions bc, bd are linear as shown in FIG. 4A, but the present invention is not limited to this example. For example, the inclined regions be, bd may be curved so as to be convex outward from the passage part 22, as long as the radii of curvature of the inclined regions bc, bd are larger than the first curvature radius of the curved-region 22*rc* and the second curvature radius of the curved-region 22*rd*, respectively, when seen in the section shown in FIG. 4A. Even when the first curvature radius of the curved-region 22*rc* and the second curvature radius of the curved-region 22*rd* are different from each other, the inclined regions bc, bd may be curved as long as the radii of curvature of the inclined regions are larger than the first curvature radius of the curved-region 22*rc* and the second curvature radius of the curved-region 22*rd*, respectively. Alternatively, one of the inclined regions bc, bd may be linear and the other may be curved, and in that case, the curvature radius of the curved inclined region should be larger than the curvature radius of the curved-region continuously connected to that inclined region. In all these cases, the width between the inclined regions bc, bd narrows gradually in the outward direction OD, so that a high level of the fluid surface C can be secured.

The bottom region bb in the above embodiment has a shape that is curved so as to be convex in the outward direction OD as shown in FIG. 4A, but the present invention is not limited to this example. For example, when seen in the section shown in FIG. 4A, the bottom region bb may have a shape that is convex in the outward direction OD such that the two linear sides intersect each other without curving, or a linear shape orthogonal to the radial direction. In that case, too, the width between the inclined regions bc, bd narrows gradually in the outward direction OD, so that a high level of the fluid surface C can be secured.

While the embodiment of the present invention has been described in detail, the present invention is not limited to this particular embodiment, but various modifications and changes can be made thereto within the scope of the gist of the present invention defined by the claims.

What is claimed is:

1. An intake manifold of an engine including an engine main body, the intake manifold comprising:

a surge tank having an intake introduction port that is configured such that intake air is introduced through the intake introduction port, and a gas introduction port that is configured such that blowby gas is introduced from the engine main body through the gas introduction port; and an intake passage part communicating with the surge tank, the intake passage part extending so as to be curved around the surge tank, and the intake passage part being configured to be connected to a cylinder head of the engine main body, wherein an inner surface of the intake passage part includes:

an inner peripheral region being on an inner side in a curvature radius direction of the intake passage part;

an outer peripheral region being apart at a distance from the inner peripheral region outward in the curvature radius direction, the outer peripheral region facing the inner peripheral region;

a first lateral region and a second lateral region being located at a distance from each other in a orthogonal direction that is orthogonal to the curvature radius direction, the first lateral region and the second lateral region continuing from the inner peripheral region;

a first curved-region being convex outward from the inner side of the intake passage part, the first curved-region connecting the first lateral region and the outer peripheral region; and a second curved-region being convex outward from the inner side of the intake passage part, the second curved-region connecting the second lateral region and the outer peripheral region, the outer peripheral region includes a first inclined region,a second inclined region, and a bottom region, the first inclined region and the second inclined region extend so as to approach each other, the first inclined region and the second inclined region extend respectively from the first curved-region and the second curved-region, when seen in a section orthogonal to a center axis of the intake passage part, the first inclined region has one of two shapes that are a linear shape, and a curved shape that is convex outward from the inner side of the intake passage part at a curvature radius larger than a first curvature radius of the first curved-region, when seen in the section, the second inclined region has one of two shapes that are a linear shape, and a curved shape that is convex outward from the inner side of the intake passage part at a curvature radius larger than a second curvature radius of the second curved-region, the bottom region is located between the first inclined region and the second inclined region, and when seen in the section, the bottom region has one of two shapes that are a linear shape orthogonal to the direction of the curvature radius, and a shape convex outward from the inner side of the intake passage part in the direction of the curvature radius.

2. The intake manifold according to claim 1, wherein, in a state of the intake manifold being installed on the engine main body, a bottom zone of the intake passage part includes a lowest position in a vertical direction in the section, and in the state of the intake manifold being installed on the engine main body, the outer peripheral region includes the first inclined region, the second inclined region, and the bottom region in a zone including the bottom zone of the intake passage part that is located further on a lower side in the vertical direction than the surge tank.

3. The intake manifold according to claim 1, wherein, in a state of the intake manifold being installed on the engine main body, a bottom zone of the intake passage part includes a lowest position in a vertical direction in the section, in the state of the intake manifold being installed on the engine main body, the outer peripheral region includes the first inclined region, the second inclined region, and the bottom region in a zone of the intake passage part on an upstream side from the bottom zone, including the bottom zone.

4. The intake manifold according to claim 1, wherein, in a state of the intake manifold being installed on the engine main body, a bottom zone of the intake passage part includes a lowest position in a vertical direction in the section, the outer peripheral region in the bottom zone is configured such that, when 10 $cm^3$ of a fluid is accumulated in the bottom zone of the intake passage part in the state of the intake manifold being installed on the engine main body, a level of a surface of the fluid is 3 mm or higher.

5. An engine comprising:

an engine main body;

and intake manifold including a surge tank having an intake introduction port through which intake air is configured to be introduced, and a gas introduction port through which blowby gas is configured to be introduced from the engine main body, and an intake passage part communicating with the surge tank, the intake passage part extending so as to be curved around the surge tank, and the intake passage part being configured to be connected to a cylinder head of the engine main body, wherein an inner surface of the intake passage part includes an inner peripheral region being on an inner side in a curvature radius direction of the intake passage part, an outer peripheral region being apart at a distance from the inner peripheral region outward in the curvature radius direction, the outer peripheral region facing the inner peripheral region, a first lateral region and a second lateral region being located at a distance from each other in a orthogonal direction that is orthogonal to the curvature radius direction, the first lateral region and the second lateral region continuing from the inner peripheral region, a first curved-region being convex outward from the inner side of the intake passage part, the first curved-region connecting the first lateral region and the outer peripheral region, and a second curved-region being convex outward from the inner side of the intake passage part, the second curved-region connecting the second lateral region and the outer peripheral region, in a state of the intake manifold being installed on the engine main body, a bottom zone of the intake passage part includes a lowest position in a vertical direction in a section orthogonal to a center axis of the intake passage part, the outer peripheral region includes a first inclined region,a second inclined region, and a bottom region, the first inclined region and the second inclined region extend so as to approach each other, the first inclined region and the second inclined region extend respectively from the first curved-region and the second curved-region, when seen in the section, the first inclined region has one of two shapes that are a linear shape, and a curved shape that is convex outward from the inner side of the intake passage part at a curvature radius larger than a first curvature radius of the first curved-region, when seen in the section, the second inclined region has one of two shapes that are a linear shape, and a curved shape that is convex outward from the inner side of the intake passage part at a curvature radius larger than a second curvature radius of the second curved-region, the bottom region is located between the first inclined region and the second inclined region, and when seen in the section, the bottom region has one of two shapes that are a linear shape orthogonal to the direction of the curvature radius, and a shape convex outward from the inner side of the intake passage part in the direction of the curvature radius, an intake passage connected to the intake introduction port; and a blowby gas reduction device provided between the gas introduction port and a crankcase of the engine main body.

* * * * *